US009334105B2

(12) United States Patent
Dinter et al.

(10) Patent No.: US 9,334,105 B2
(45) Date of Patent: May 10, 2016

(54) SEA CONTAINER THAT CAN BE CLOSED ON ALL SIDES

(75) Inventors: Jens-Heiko Dinter, Syke (DE); Uwe Fass, Bremen (DE)

(73) Assignee: Atlas Elektronik GmbH (DE)

( * ) Notice: Subject to any disclaimer, the term of this patent is extended or adjusted under 35 U.S.C. 154(b) by 270 days.

(21) Appl. No.: 13/980,077

(22) PCT Filed: Feb. 23, 2012

(86) PCT No.: PCT/EP2012/053103

§ 371 (c)(1),
(2), (4) Date: Jul. 17, 2013

(87) PCT Pub. No.: WO2012/113885

PCT Pub. Date: Aug. 30, 2012

(65) Prior Publication Data

US 2013/0299489 A1 Nov. 14, 2013

(30) Foreign Application Priority Data

Feb. 25, 2011 (DE) ..... 10 2011 000 950

(51) Int. Cl.
*B65D 88/12* (2006.01)
*B65D 90/00* (2006.01)
*E04H 1/12* (2006.01)

(52) U.S. Cl.
CPC ..... *B65D 88/121* (2013.01); *B65D 90/00* (2013.01); *E04H 2001/1283* (2013.01)

(58) Field of Classification Search
CPC ..... B65D 88/121; B65D 90/00; E04H 2001/1283
See application file for complete search history.

(56) References Cited

U.S. PATENT DOCUMENTS 3,480,174 A 11/1969 Sherwood
3,717,325 A * 2/1973 Peterson ..... B66D 1/741 212/71
4,565,333 A * 1/1986 Meneian ..... H02G 11/02 242/365.2
4,621,587 A * 11/1986 Pool ..... B63B 1/121 114/343
2007/0291587 A1* 12/2007 Gros ..... G01V 1/3861 367/16

(Continued)

FOREIGN PATENT DOCUMENTS

AU WO 0062607 A1 * 10/2000 ..... A01M 13/003
EP 0941945 A1 9/1999
EP 1892200 A1 2/2008

(Continued)

OTHER PUBLICATIONS

International Search Report from corresponding International Application No. PCT/EP2012/053103, mailed Jun. 20, 2012 (English Translation included).

*Primary Examiner* — Daniel Pihulic
(74) *Attorney, Agent, or Firm* — Polster Lieder

(57) ABSTRACT

The invention relates to a sea container that can be closed on all sides, comprising a base frame, which has four corner posts, a top-side frame, and a bottom-side frame construction, wherein the corner posts are rigidly connected to the top-side frame and to the bottom-side frame construction. The bottom-side frame construction has a bearing frame, wherein installations in the container are fastened to the bearing frame and the bearing frame has tie-down means for tying down and for absorbing forces acting horizontally. Thus the invention makes it possible to accommodate installations such as a deploying device for a trailling antenna in a sea container even though traditional sea containers are unsuitable therefor.

23 Claims, 7 Drawing Sheets

(56) References Cited

U.S. PATENT DOCUMENTS

2008/0223698 A1* 9/2008 Poyner ..... H01H 27/002
200/61.76
2013/0299489 A1* 11/2013 Dinter ..... B65D 88/121
220/1.5

FOREIGN PATENT DOCUMENTS

GB 2089768 A * 6/1982 ..... B65D 88/126
WO 0216230 A1 2/2002

* cited by examiner

SEA CONTAINER THAT CAN BE CLOSED ON ALL SIDES

CROSS-REFERENCE TO RELATED APPLICATIONS

The present invention is the US national stage under 35 U.S.C. §371 of International Application No. PCT/EP2012/053103, which was filed on Feb. 23, 2012 and which claims the priority of application DE 10 2011 000 950.7 filed on Feb. 25, 2011 the content of which (text, drawings and claims) is incorporated here by reference in its entirety.

FIELD

The invention relates to a sea container that can be closed on all sides.

BACKGROUND

Generally, sea containers comprise a basic frame which has four corner posts, a top-side frame and a bottom-side frame structure, the corner posts being fixedly connected to the top-side frame and the bottom-side frame structure.

Corner fittings on the bottom-side frame structure typically serve for positioning containers on mounting points provided on the deck of a vessel. Corner fittings on the top-side frame also serve for receiving lashing bars which are intended to prevent a container tipping over with the movement of the vessel.

The mounting points in combination with the corner fittings prevent the container from slipping on-board a vessel. Such corner fittings as well as the mounting points, however, are only able to absorb horizontal forces to a very limited extent.

It is conventionally not provided to deposit containers on the deck of a vessel outside such mounting points, as containers deposited in this manner are at risk of slipping which constitutes a danger for the vessel and the crew.

SUMMARY

The object of the invention, therefore, is to increase the potential use of such known sea containers.

The invention achieves this object by means of a sea container wherein the bottom-side frame structure comprises a bearing frame, installations in the container being fastened to the bearing frame and the bearing frame comprising lashing means for lashing down and for absorbing horizontally-acting forces.

The invention thus permits heavy and large installations to be implemented in sea containers, the installations exerting tensile forces and/or torques onto the container from outside the container. The tensile forces and/or torques are introduced via the installations directly onto the bearing frame which is of robust configuration. The resulting forces can be transmitted from the bearing frame to the vessel via cables or chains. Thus, a stable structure, which is also able to absorb high tensile forces, is produced. Such high tensile forces can, for example, be produced when the installations comprise a winch mounted on the bearing frame for a trailing antenna of a sonar system or a deploying system, for example a crane mounted on the bearing frame, for underwater vessels or surface vessels or underwater moving bodies. Generally, containers are only used for transport or storage purposes. By means of the invention, however, there is also the possibility of using containers as part of mobile devices which are subjected to significantly greater forces and torques than containers provided simply for transport or storage purposes.

By means of the invention, a container can also be deposited at a position on the deck of a vessel which has not been prepared for depositing containers. For example, therefore, a container can be deposited on a helicopter deck of a vessel, which conventionally does not have any mounting points for receiving corner fittings of the container.

As a whole, therefore, a container according to the invention permits the potential use of sea containers to be substantially increased due to the additional bearing frame and the lashing means for receiving horizontally-acting forces.

According to various embodiments, the bottom-side frame structure above the bearing frame comprises an upper bottom-side frame, which is welded to the bearing frame. The upper bottom-side frame comprises four corner fittings, two longitudinal members and two transverse members, the corner fittings in each case being connected fixedly to one end of one of the corner posts.

In such a structure, a standard container can be used without the conventionally provided bottom wooden panels, the standard container being positioned on the bearing frame according to the invention and being welded thereto. The construction permits a cost-effective structure, as it is possible to use standard components of the container structure. In this case, however, the particular stress due to specific installations in the container does not have to be borne by the components of the standard container but simply by the specific structure of the bearing frame, which receives at least some of the mechanically demanding installations, such as winches, cranes and the like. In this case, the forces and torques introduced into the bearing frame do not enter the components of the standard container but are transmitted directly to the vessel via the lashing means. The components of a standard container thus remain unloaded and primarily serve for covering the top of the installations. The installations are thus able to be protected from environmental influences and unauthorised access.

According to various embodiments, the bearing frame comprises four corner fittings at its corners as well as two longitudinal bearing frame members fixedly connected to the corner fittings and two transverse bearing frame members fixedly connected to the corner fittings. The lashing means are provided between one or more pairs of adjacent corner fittings of the bearing frame on one or both longitudinal bearing frame members and/or on one or both transverse bearing frame members. The container according to the invention thus comprises corner fittings in the bottom region thereof, notwithstanding the additional bearing frame, whereby the transport of the container can be effected by conventional trailers. Moreover, the additional receiving points permit the container to be deposited at normal container positioning points on-board a vessel. The corner fittings, however, are not available for receiving horizontal tensile forces as they are conventionally provided for lashing bars acting substantially perpendicularly and/or obliquely. Thus, between the corner fittings the lashing means are advantageously provided for horizontal lashing down and for receiving horizontally-acting forces. Advantageously, the lashing means are located in opposing positions, i.e. symmetrically to the longitudinal axis and/or transverse axis of the container, so that the lashing forces and the resulting mechanical stresses are able to be distributed uniformly over the bearing frame.

In various embodiments, the bearing frame comprises transverse members which are arranged between the longitudinal bearing frame members and are fixedly connected thereto and to which at least some of the installations are fastened. Advantageously, a stable fastening is produced for heavy installations which may introduce large forces and torques into the container. In various embodiments, the aforementioned lashing means are provided in the region of the connection of the longitudinal bearing frame members to the transverse members. This reduces bending moments in the longitudinal bearing frame members.

In various embodiments, the installations comprise a winch for a trailing antenna of a sonar system, a winch frame for receiving the winch being fastened to the bearing frame, in particular to two of the aforementioned transverse members. Advantageously, therefore, a mobile trailing antenna sonar system can be provided which can be used on merchant vessels, for example for protecting against pirates and/or for protecting a group of vessels, in particular merchant vessels and/or marine vessels. Merchant vessels generally do not have complex sonar systems for locating other vessels and/or boats, by means of which vessels or boats can also be located beyond the horizon. In particular, therefore, when detecting potential enemy vessels, in particular pirates, merchant vessels are often limited to a range as far as the visible horizon. In contrast, sonar systems have a considerably greater range. A merchant vessel is thus able to identify potential enemy vessels or boats even over a great distance and thus take suitable measures, including changing course or setting off an emergency signal.

By means of the container according to the invention, therefore, trailing antenna sonar systems can be installed on-board virtually any vessel or other floating platforms or even on land, for example in the region of harbours, in particular on a quay, and even temporarily, for example when an area of the ocean subject to frequent pirate assaults has to be crossed. Moreover, larger groups of merchant vessels and/or marine vessels can be provided cost-effectively with trailing antenna sonar systems—even temporarily—which increases the safety of ocean navigation.

In various embodiments, the installations comprise a deploying system for unmanned and/or manned underwater vessels and/or surface water vessels and/or underwater moving bodies for deploying such a vessel and/or underwater moving body in sea water, the deploying system being fastened to the bearing frame, in particular to two of the transverse members. Advantageously, therefore, a mobile deploying system can be provided for unmanned underwater vessels, in particular autonomous unmanned underwater vessels, but also remotely-controlled underwater vessels and unmanned surface water vessels but also for underwater moving bodies of any type. Such underwater vessels are, in particular, used in mine sweeping and/or mine clearance. By means of the invention, therefore, a mine sweeping and/or mine clearance system which is able to be deployed easily, is mobile and thus cost-effective, can also be provided. In particular, due to the invention such systems can also be accommodated on vessels not actually provided for the respective purpose so that the invention not only significantly increases the potential use of containers but also marine vessels as a whole.

In various embodiments, the bearing frame comprises one or more floor panels for shielding the container interior from the surroundings on the bottom-side, the floor panel(s) comprising one or more draining means, in particular bilge plugs, bilge flaps and/or bilge pumps. Thus, in an advantageous manner, admitted sea water or rain water as well as condensation water can be easily discharged. In particular when retrieving a trailing antenna or a water vessel, sea water can regularly come on-board and thus enter the container. Due to the aforementioned draining means, the water can be easily removed again from the container.

According to various embodiments, the container interior is divided into two by a partition and thus comprises a control room and a working space, the control room being hermetically sealed and/or being able to be hermetically sealed from the surroundings. The control room serves as a control station for one or more operators who have to perform their duties even in adverse environmental conditions over many hours or even days in the control room. The control room is thus intended to be equipped as comfortably as possible in order to be able to perform correctly a task requiring a high degree of concentration even in difficult weather conditions. Moreover, a hermetic seal also permits the protection of electronic components, in particular against moisture, and thus permits the use of many different types of electronic devices, such as for example conventional computer screens, printers, etc. in the control room.

The working space is, in particular, provided for the aforementioned winch of a trailing antenna or, for example, for the deploying system for underwater vessels and/or surface water vessels as well as underwater moving bodies. A hermetic seal of the working space is not necessary as the working space is open during operation in any case and thus air is exchanged with the ambient air.

In various embodiments, the control room comprises an access door, an emergency exit for leaving the control room in an emergency, a window to the working space, an air conditioning system, heat insulation for insulating the control room relative to the surroundings, a heating system, fire extinguishing means, first-aid means, a satellite telephone system, communication devices for communication, including data communication, with devices on-board the vessel accommodating the container and/or with devices outside the vessel, signal processing devices of a sonar system, electronic data processing devices, amongst other things, for processing, for example, sonar data, an emergency power supply, a satellite navigation system, for example a GPS (Global Positioning System) i.e. a satellite-assisted position locating system, an AIS i.e. an automatic identification system and/or further office equipment, such as chairs and tables. Thus, a control station fully equipped with all necessary devices is advantageously provided for round-the-clock use by personnel.

In particular, in the case where the installations comprise a sonar system, the operation of such a sonar system requires a high degree of concentration on the part of the operator over many hours or days. Thus, extreme environmental conditions, for example at very low temperatures or very high temperatures and at a high level of air humidity, can be reduced to a tolerable level as far as possible.

In a further advantageous embodiments, the installations comprise a voltage transformer for providing a predetermined and/or predeterminable initial voltage at variable input voltage. In various embodiments, the voltage transformer is accommodated in the working space. By means of a cable through-guide and/or a connection to the outside of the container, therefore, an external power supply can be connected to the container, the power supply not requiring any particular specification. Instead, the voltage transformer installed in the container ensures that the further electrical and electronic components inside the container receive the required electrical voltages. Thus, the container and, in particular, the installations thereof can be operated on many different types of vessel with different on-board power supply systems. The container according to the invention can be used and its installations can be operated even on a vessel without its own power supply, for example a sailing vessel. In this case, it would merely be required to connect an external power generator to the container.

In various embodiments, the bottom-side frame structure, in particular the bearing frame, comprises external earthing points for the electrical earthing of the container. Due to the earthing points, it is possible to discharge even large electrical loads which can be produced for example by moving parts, such as a winch, or a malfunction, for example a short circuit.

In various embodiments, the longitudinal members and/or transverse members of the basic frame, in particular of the upper bottom-side frame and/or the bearing frame, are provided as cable ducts. Such supports are often H-girders (I-girders), the transverse web thereof being arranged perpendicularly, or U-shaped girders. Thus, the H-girders and/or U-shaped girders provide the option of receiving cables. In this case, however, care has to be taken that the cables do not fall out of the hollow spaces of the H-girders and/or U-shaped girders. To this end, sealing elements are provided on the girders which partially seal the recesses externally, so that the region between the girders and the sealing element forms a cable guide. This is advantageous as "floating" cables are thus avoided in the region of the container. This increases the occupational safety, as the risk of tripping due to such "floating" cables is avoided.

In various embodiments, the working space comprises an access door arranged on a side wall of the container, the container comprising a safety circuit which, when the access door is open, interrupts the electrical supply of an electrical drive in the working space, in particular of the winch and/or the deploying system and when the access door is closed, connects the electrical supply to the electrical drive. Thus, the risk of personnel entering the working space is avoided, as an opening of the access door automatically stops such drives. In this manner, the occupational safety is enhanced in the working space.

In various embodiments, the access door of the control room and/or the access door of the working space is offset inwardly relative to the external dimensions of the container. Thus, it is ensured that even door handles or door locks of the access doors do not protrude beyond the external dimensions of the container and thus the container is able to be transported and stored in the manner of any other standard sea container.

In various embodiments, the winch of the trailing antenna comprises a mechanical locking brake. Thus, even in the case of failure of the electrical power supply, the trailing antenna is prevented from unwinding in an uncontrolled manner. Moreover, however, even when deploying any length of trailing antenna, the winch can be stopped without further electrical power being required after the stopping thereof.

In various embodiments, the winch comprises a slip ring for transmitting electrical and/or optical signals. This is advantageous, as trailing antennae of sonar systems already require an electrical power supply inside the trailing antenna to supply electro-acoustic transducers and for signal processing, and the sensor signals thus produced have to be transmitted from the trailing antenna into the data processing system of the sonar system. In various embodiments, this takes place by means of electrical and/or optical signals. The particular design of the winch permits the transport of the signals.

In various embodiments, the winch comprises an impulse transmitter for determining the dispensed length of cable and/or trailing antenna, and a winch control unit which is configured such that, during operation of the winch, a minimum number of windings, for example at least three windings, of the tensioning cable remains on the winch drum. Such a minimum number of windings ensures traction relief in the region of the winch drum.

DRAWINGS

Various embodiments are revealed from the claims as well as from the exemplary embodiments described in more detail with reference to the drawings.

DETAILED DESCRIPTION

Figure 1:
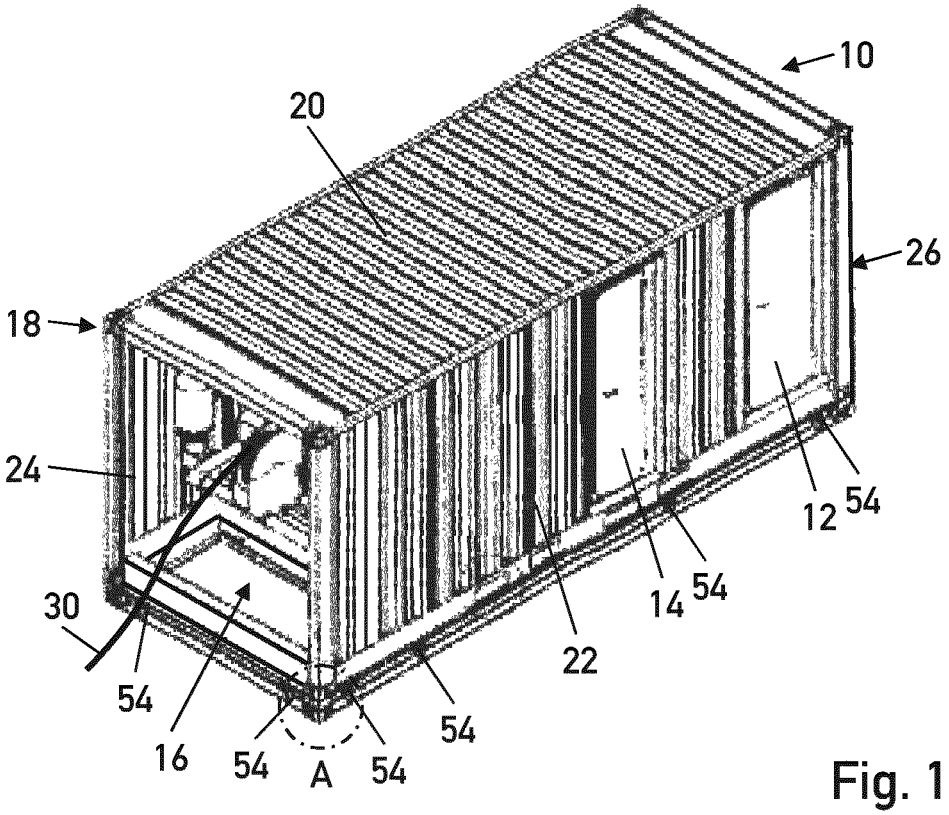
FIG. 1 shows a perspective view of a sea container that can be closed on all sides according to various exemplary embodiments of the invention.

FIG. 1 shows a sea container 10 that can be closed on all sides and for this purpose comprises an access door 12 to a control room and an access door 14 for an working space, in which installations 16 fixedly installed in the sea container 10 are accommodated. The front face 18 on the rear side is able to be closed by means of a door, in particular a 2-leaf door (not shown).

Figure 2:
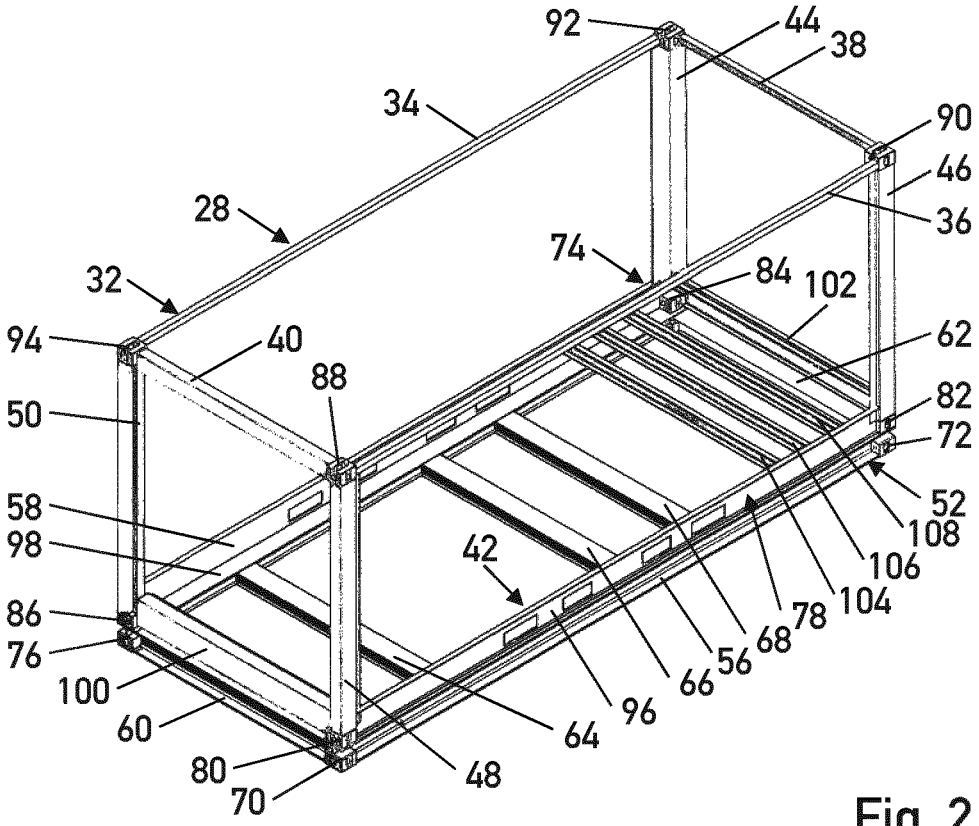
FIG. 2 shows a basic frame of the sea container according to FIG. 1 in accordance with various embodiments of the invention.

The top surface 20, the side walls 22, 24, the front wall 26 and optionally also the door surfaces in the region of the front face 18 on the rear side are made from profiled steel sheets and connected to a basic frame 28 which is described in more detail hereinafter in connection with FIG. 2.

The installations 16 according to FIG. 1 comprise an electrically-operated winch for receiving and deploying and retrieving a trailing antenna 30 of a sonar system. The trailing antenna has a tensioning cable having a length of several 100 meters as well as a portion with electro-acoustic transducers and an end section for stabilising and aligning the trailing antenna in the water. In particular, the acoustically relevant components of the trailing antenna have a diameter of approximately 5 to 10 cm. A trailing antenna which has been deployed, therefore, has a considerable flow resistance due to its length, its diameter as well as the end section, so that the aforementioned winch has to apply large tensile forces and/or is subjected to the tensile forces when the trailing antenna 30 is pulled along or is retrieved. The tensile forces, however, also act on the sea container 10. Standard sea containers of a conventional type merely have wooden floors which are not suitable for fastening winches subjected to such high tensile forces, as the wooden floors would be ripped out of their anchoring points. Also, the remaining structure of such conventional sea containers is not designed to be subjected to the tensile force which occurs when deploying and/or retrieving such trailing antennae.

The sea container 10 according to the invention, therefore, has a basic frame 28 which is reinforced relative to conventional sea containers and which comprises a top-side frame 32 with two top longitudinal members 34, 36 as well as two top transverse members 38, 40. The basic frame 28 also has a bottom-side frame structure 42, the bottom-side frame structure 42 and the top-side frame 32 being connected fixedly together, in particular welded, via the corner posts 44, 46, 48, 50.

Figure 4:
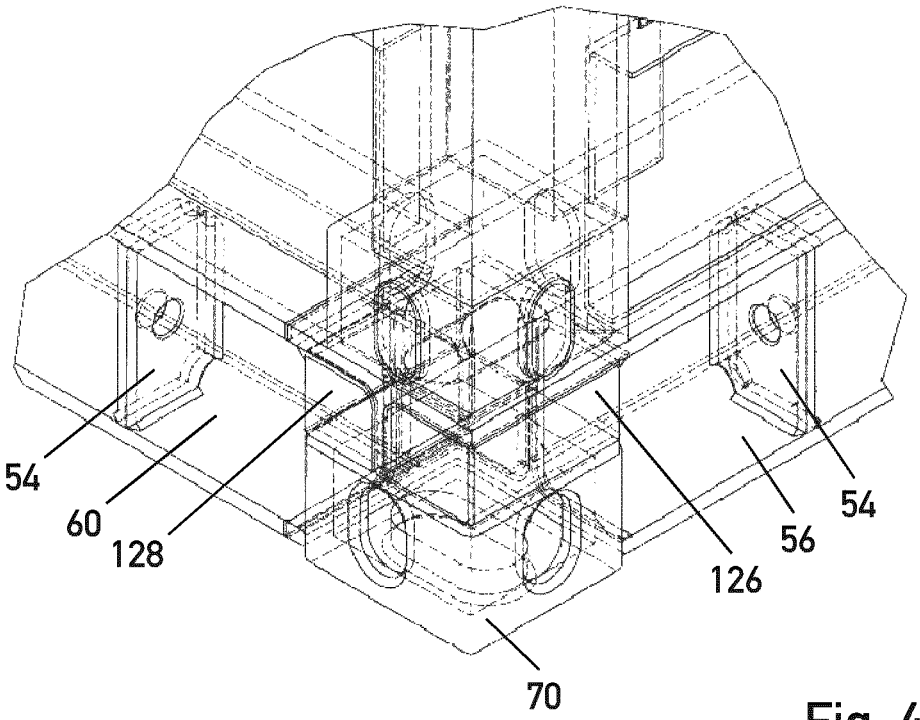
FIG. 4 shows an enlarged detail A according to FIG. 1 in the region of a corner fitting in accordance with various embodiments of the invention.

The bottom-side frame structure 42 has a bearing frame 52, at least some of the installations 16, in particular the aforementioned winch, being fastened to the bearing frame 52, and the bearing frame 52 additionally having lashing means 54, shown for example in FIGS. 1 and 4, for lashing down and for receiving horizontally-acting forces. The lashing means 54 can be configured as eye-plates which are welded in longitudinal bearing frame members 56, 58 as well as transverse bearing frame members 60, 62.

The longitudinal bearing frame members 56, 58 and transverse bearing frame members 60, 62 can be configured as so-called H-girders and/or so-called I-girders. The aforementioned eye plates 54 are welded into the C-shape grooves of the longitudinal bearing frame members 56, 58 as well as transverse bearing frame members 60, 62. The eye plates 54 have a recess, in particular a through-hole, for receiving a shackle. They are adapted to the contour of the H-girders and chamfered and welded to the girders by means of a fillet weld.

The bearing frame 52 also has transverse members 64, 66, 68, which in each case are arranged between the longitudinal bearing frame members 56, 58 and fixedly connected thereto, in particular welded thereto. The installations 16 can be connected to the transverse members 64, 66, 68, so that forces which are introduced via the installations 16 are forwarded to the bearing frame 52 via the transverse members 64, 66, 68, but without subjecting the structure of the basic frame 28 located above the bearing frame 52 to load in this case. The forces and/or torques introduced into the bearing frame 52 are directly introduced by the lashing means 54 into a vessel or a further offshore or land-based platform on which the container 10 is located.

At its corners, the bearing frame 52 has corner fittings 70, 72, 74, 76 which are fixedly connected, in particular welded, to the longitudinal bearing frame members 56, 58 as well as the transverse bearing frame members 60, 62. The corner fittings 70, 72, 74, 76 have eyes for receiving lashing bars as well as recesses and/or openings on the bottom for receiving mounting pins.

The bottom-side frame structure 42 has a further frame above the bearing frame 52, namely an upper bottom-side frame 78 which is welded to the bearing frame 52. The upper bottom-side frame 78 is a component of a conventional sea container. It also has, therefore, four corner fittings 80, 82, 84, 86 which are configured in a similar manner to the corner fittings 70, 72, 74, 76. The corner fittings 80, 82, 84, 86, however, are not necessary due to the provision of the corner fittings 70, 72, 74, 76 and thus can be dispensed with in alternative embodiments.

Moreover, the top-side frame 32 also has four corner fittings 88, 90, 92, 94. The corner fittings 88, 90, 92, 94 are configured in a similar manner to the corner fittings 70, 72, 74, 76 and serve, in particular, for receiving lashing bars but also as anchoring points for a further container deposited on the sea container 10.

The upper bottom-side frame 78 has two longitudinal members 96, 98 as well as two transverse members 100, 102 between the corner fittings 80, 82, 84, 86. Transverse beams 104, 106, 108 are attached between the longitudinal members 96, 98 of the upper bottom-side frame 78, the beams serving to receive floor panels, in particular wooden panels, of the control room.

Figure 3:
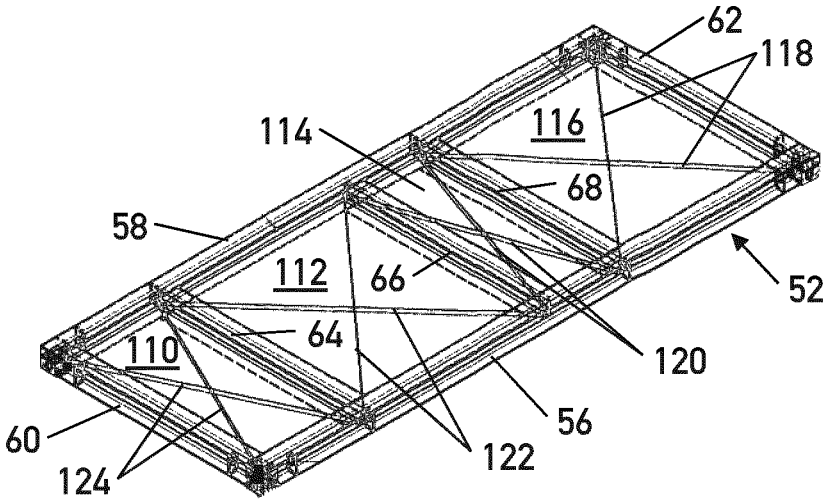
FIG. 3 shows a bearing frame of a basic frame according to FIG. 2 with further details in accordance with various embodiments of the invention.

FIG. 3 shows the bearing frame 52 with further details but without the frame structure located thereabove. The transverse members 64, 66, 68 separate the surface spanned by the longitudinal bearing frame members 56, 58 and the transverse bearing frame members 60, 62 into a plurality of partial surfaces. Each of the partial surfaces has a floor panel 110, 112, 114, 116, which in each case on all sides is fully welded to the respectively surrounding longitudinal bearing frame members 56, 58 as well as the transverse bearing frame members 60, 62 and/or transverse members 64, 66, 68. The floor panels 110, 112, 114, 116 are reinforced by reinforcements 118, 120, 122, 124, advantageously configured as flat steel.

One or more draining means, in particular bilge plugs, bilge flaps and/or bilge pumps are located in the region of one, several or all floor panels 110, 112, 114, 116, in order to be able to discharge admitted sea water and/or rain water or condensation water.

FIG. 4 shows the region around the corner fitting 70 in a detailed view. The longitudinal bearing frame member 56 is notched at the bottom in the region of the corner fitting 70, so that the corner fitting 70 is fitted into this region. Two steel blocks 126, 128 are located above the corner fitting 70, the steel blocks filling up the hollow space between the remaining end portion of the longitudinal bearing frame member 56 and the corner fitting 70. The steel blocks 126, 128 are solid and adapted to the shape of the surrounding components, and welded thereto.

Figure 5:
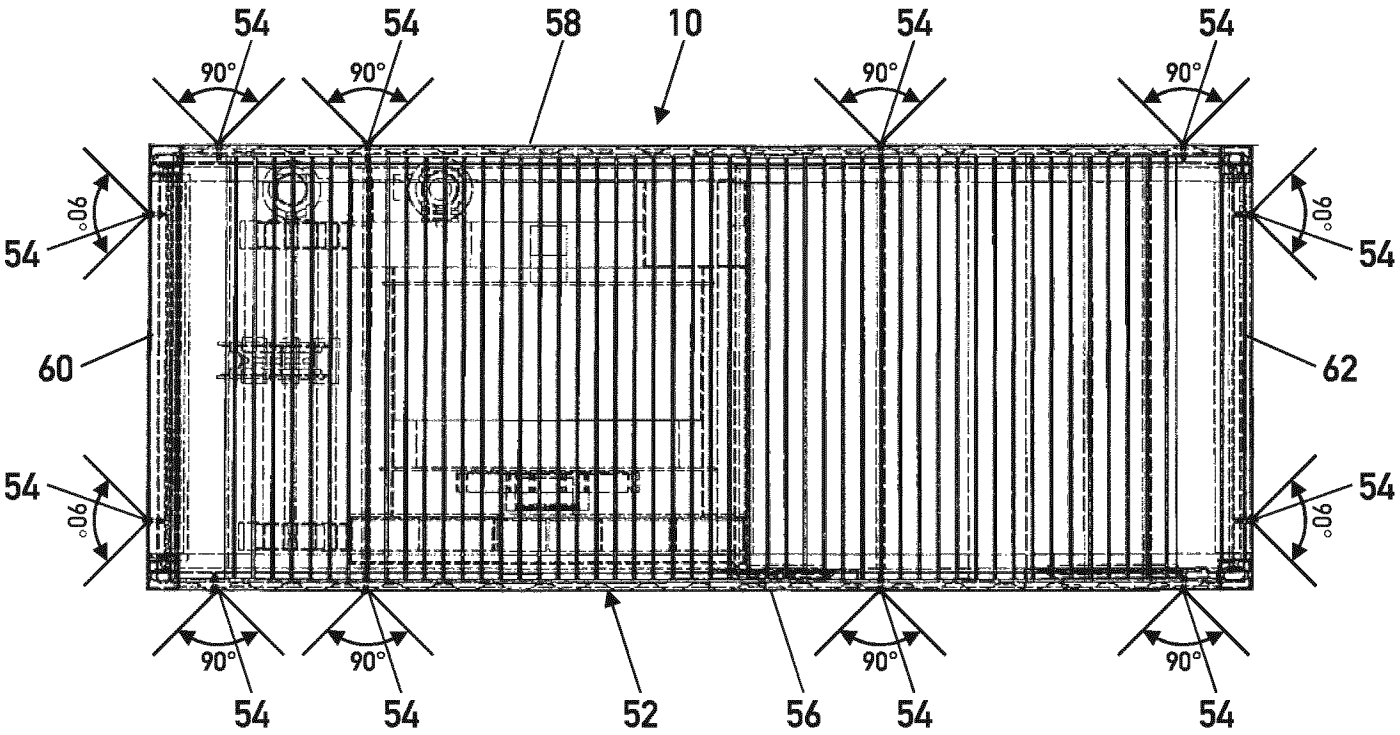
FIG. 5 shows the sea container according to FIG. 1 in a view from above to illustrate the position of the lashing means in accordance with various embodiments of the invention.

FIG. 5 shows the sea container 10 in a view from above, the positions of the lashing means 54 being shown in more detail. In various embodiments, the positions are located symmetrically to the longitudinal axis and to the transverse axis of the container 10 so that the container 10 can be lashed down in the simplest possible manner to a flat deck without receiving points for corner fittings. Shackles can be arranged on the lashing means 54, acted upon by tensioning cables or tensioning chains, which are secured to the deck of the vessel and/or the platform. The tensioning chains and/or tensioning cables do not have to run perpendicular to the bearing frame 52. Angles ranging from +/−45 degrees to the vertical are permitted relative to the bearing frame 52.

The tensile forces exerted by the trailing antenna 30 on the bearing frame 52 are transmitted by means of the lashing means 54 to the deck of the vessel and/or the platform. The lashing means 54 are located on both longitudinal bearing frame members 56, 58 and on both transverse bearing frame members 60, 62.

Figure 6:
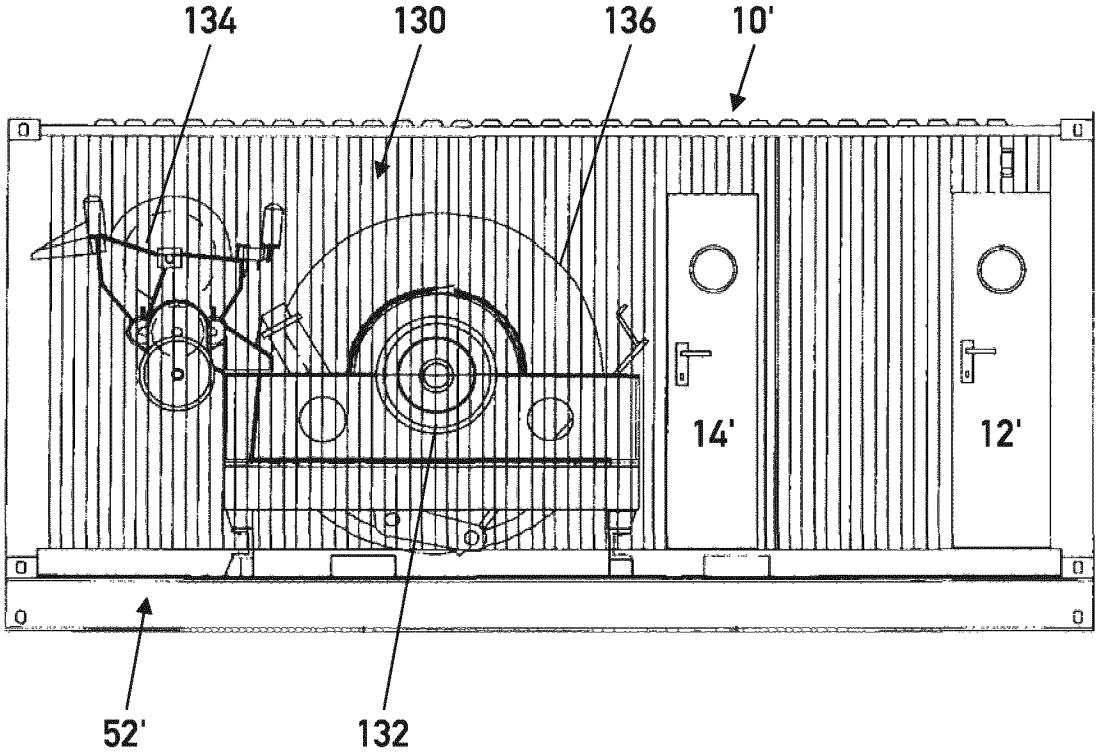
FIG. 6 shows a side view of a sea container according to other exemplary embodiments of the invention.
Figure 7:
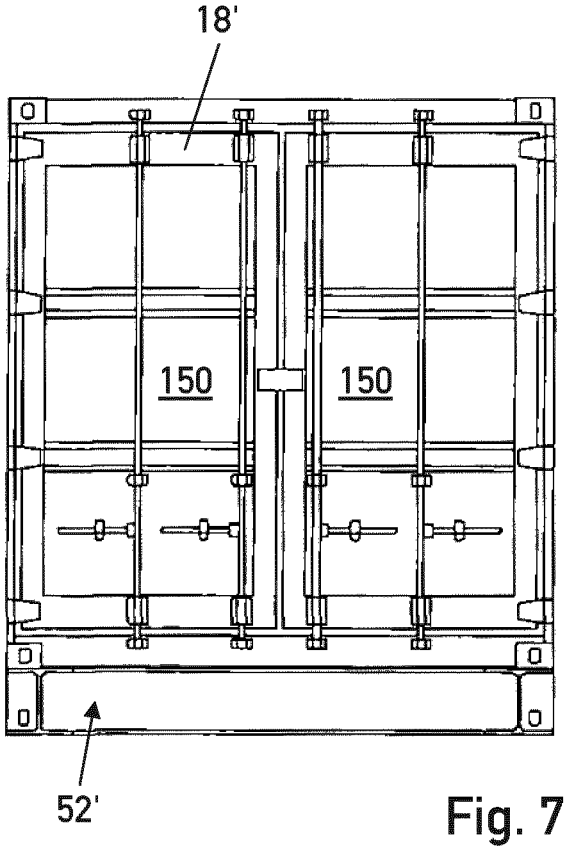
FIG. 7 shows a side view of the door side of the sea container according to FIG. 6 in accordance with various embodiments of the invention.
Figure 8:
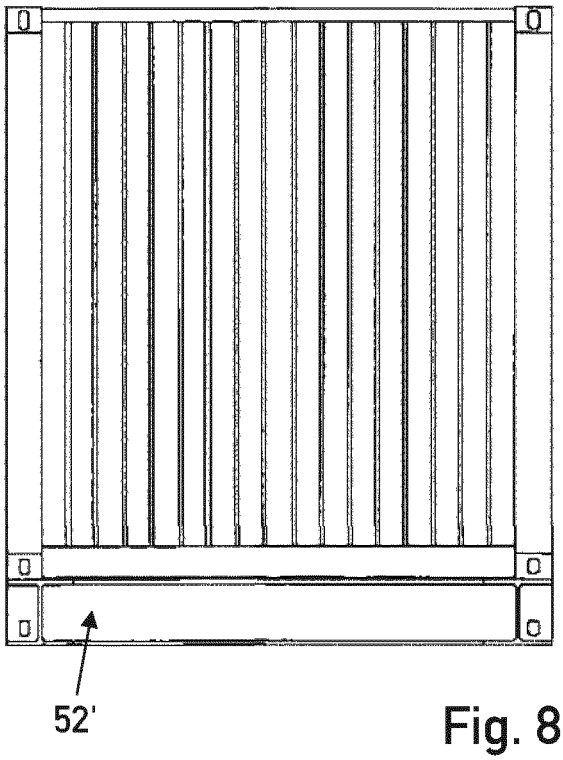
FIG. 8 shows a side view of the front face of the container according to FIG. 6 in accordance with various embodiments of the invention.

FIGS. 6 to 11 show other exemplary embodiments according to the invention which corresponds substantially to the exemplary embodiments according to FIGS. 1 to 5, but the regions at the corners of the bearing frame 52' according to FIGS. 6 to 8 as well as 10 being configured differently. Moreover, the access doors 12', 14' additionally have windows. The features of the various exemplary embodiments, however, are able to be combined together individually or in any combination.

All access doors 12, 14 and/or 12', 14' are watertight and fitted into recesses of the side wall, so that the doors 12, 12', 14, 14' including the door handles thereof do not protrude beyond the external dimensions of the sea container.

Figure 9:
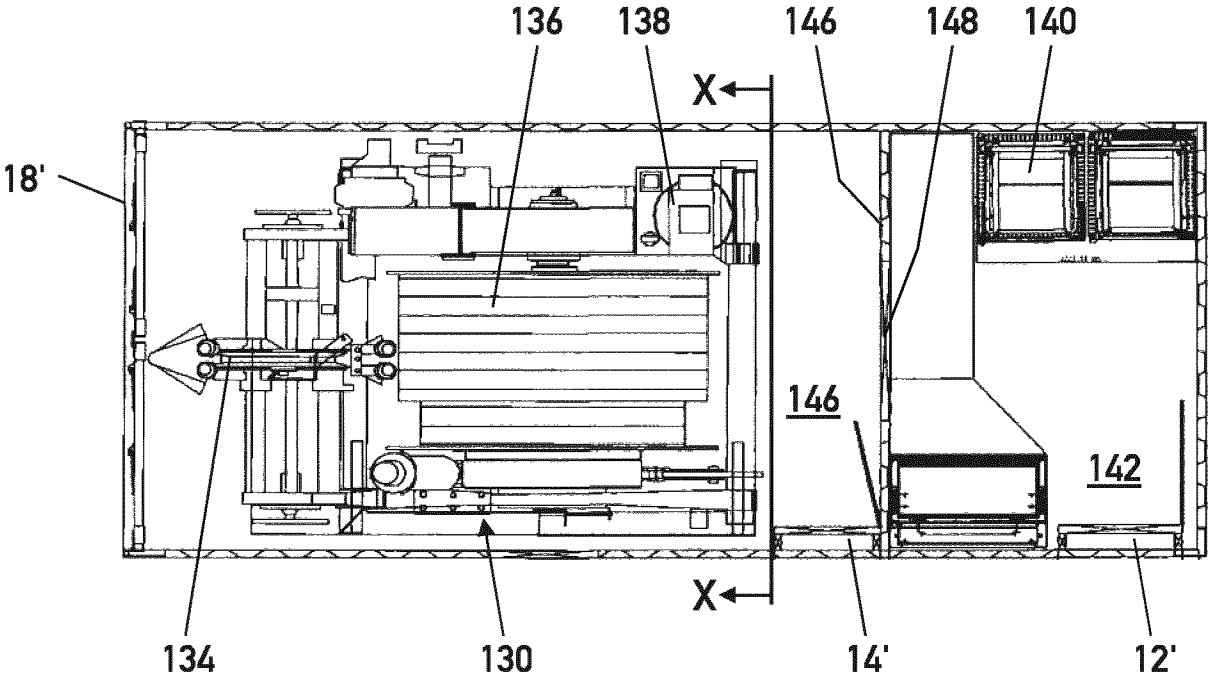
FIG. 9 shows a view from above of the sea container according to FIG. 6 but with the roof cut open in accordance with various embodiments of the invention.
Figure 10:
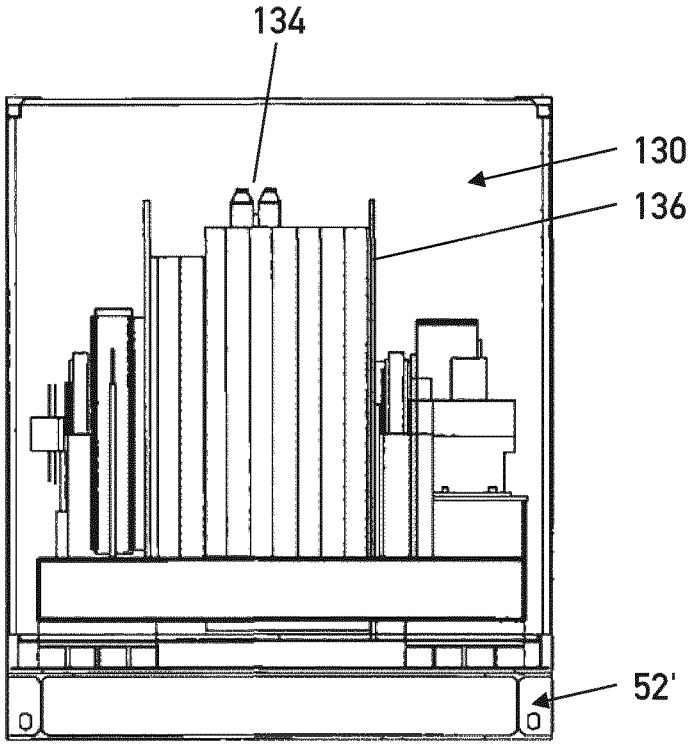
FIG. 10 shows a side sectional view along the line X-X according to FIG. 9 in accordance with various embodiments of the invention.
Figure 11:
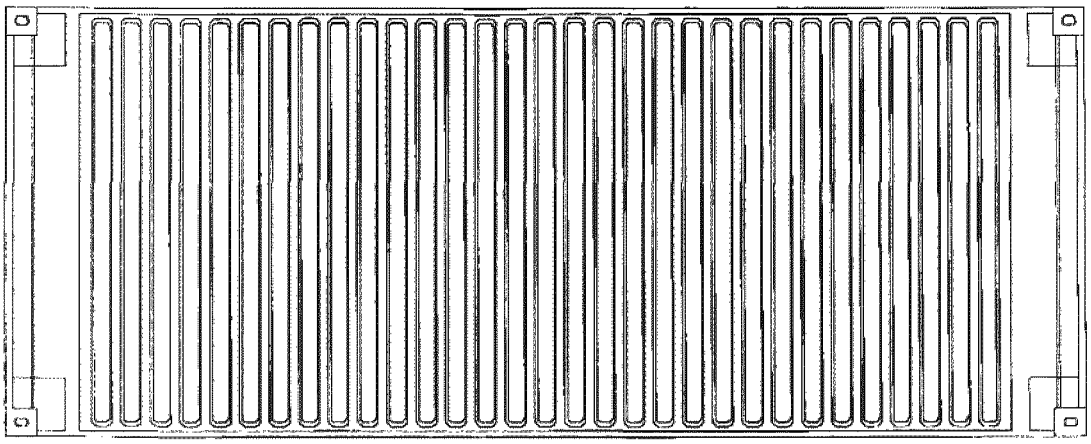
FIG. 11 shows a view from above of the sea container according to FIG. 6 in accordance with various embodiments of the invention.

FIGS. 6, 9 and 10 show a deploying device 130 for a trailing antenna, which comprises a winch 132 as well as a cable guide carriage 134 for controlled retrieving and deploying of the trailing antenna from the winch drum 136.

The deploying device 130 and/or the winch 132 further comprises an electric motor 138 for driving the winch drum 136. The winch 132 also contains a slip ring for transmitting electrical and optical signals from the trailing antenna to the sonar data processing device 140 which is arranged in the control room 142.

The control room 142 is separated by means of a partition 144 from the working space 146. The partition 144 comprises a window 148. The window 148 permits the operator in the control room 142 to monitor the deploying device 130. If visual monitoring is not possible via the window 148, a camera is also provided in the region of the front face 18' on the rear side which, in particular, is oriented toward the cable guide carriage 134. A further camera in the region of the front face 18' on the rear side is oriented out of the container in the direction of the surroundings, in order to be able to observe the path of the dispensed trailing antenna.

During operation of the sonar system, i.e. when the trailing antenna is deployed, the 2-leaf door 150 is opened in the region of the front face 18' on the rear side. The two door leafs are thus able to be fixed such that wind protection and spray water protection is provided by the door leafs. Additionally, the deployed door leafs 150, optionally together with barrier grilles, prevent personnel from entering the region in which the trailing antenna is deployed.

The winch drum 136 has two different drum diameters. A first smaller drum diameter serves for receiving the thinner but much longer tensioning cable which is provided with electrical and optical lines. A region of the winch drum 136 of greater diameter serves for receiving the acoustically effective antenna part.

The cable guide carriage 134 determines onto which region of the winch drum 136 the respective trailing antenna portion is wound when retrieved.

The sea container according to the invention thus permits a mobile deploying system for a trailing antenna of a sonar system. In this case, the sonar data processing device 140 can be arranged inside the container 140, so that the container 140 shown accommodates a complete sonar system. The deploying device 130 has the purpose of reliably depositing the trailing antenna, together with the associated trailing cable, and receiving it again. The container 10, 10' also provides the possibility of storing a trailing antenna in addition to the tensioning cable securely and to protect them during transport against damage, the effects of weather and access by unauthorised personnel.

The control room 142 is able to be hermetically sealed against environmental influences so that the control room 142 is able to accommodate directly all the sensitive electronic devices of a sonar system. Thus, the installation cost on-board a vessel and/or any other platform when equipped with a trailing antenna sensor is reduced to a minimum.

The electric motor 138 of the winch 132 is supplied via a central distributor. Moreover, the distributor supplies the lighting device, a heating device for protecting against condensation as well as an air conditioning system. The electrical connection of this distributor can take place via a three-phase supply, which is designed for voltages of 380 volts to 400 volts, a voltage transformer ensuring initial voltages of 230 volts and/or 115 volts. The initial voltage can be also provided as three-phase voltage. The container can have one or more earthing points on the bearing frame 52, 52' for connecting to the electrical earthing of the vessel.

Moreover, the container 10, 10' has a watertight cable interconnection point. The interconnection point comprises various cable guide-through elements for the voltage supply as well as for data lines and optionally communication lines to the outside. The cables are deposited and/or positioned inside the container. All regions inside and outside the container 10, 10' are able to be illuminated by means of lamps provided in the container 10, 10', so that even in darkness sufficient light can be provided for operating the deploying device 130.

If the access door 14 and/or 14' is opened, a safety circuit interrupts a winch operation which can be taking place, so that personnel are not at risk from the winch operation.

The winch 132 is able to be operated steplessly in both rotational directions. It has a mechanical locking brake which, in particular in the event of failure of the electrical power supply, grips and secures the winch drum 136 in order to avoid uncontrolled unwinding of the trailing antenna.

The winch 132 also contains an impulse transmitter which displays the dispensed length of the trailing antenna and/or the tensioning cable. The control of the winch 132 ensures that a minimum number of windings of the tensioning cable remains on the winch drum 136, in order to provide thereby traction relief of the end of the cable.

The winch 132 is able to be controlled in both directions from the control room 142, in various embodiments by means of a joystick.

The control room 142 is provided with all devices, including tables and chairs, which are required for lengthy operation of a sonar system. To this end, also included are an air conditioning system as well as heat insulation of the control room 142, as well as fire extinguishers, first-aid means as well as an emergency exit on the front face and/or the wall opposing the access door 12, 12' and/or in the top region.

The sea container according to the invention has been described in connection with a trailing antenna sonar system. Such a container can, however, also be used for accommodating and for operating further sea-based systems, such as for example unmanned and/or manned underwater vessels and/or surface water vessels and/or underwater mobile bodies. The vessels as well as the aforementioned underwater mobile bodies require a deploying device, for example a crane, which is installed inside the container and in the event of operation can exert considerable torques and forces on the container. Such a crane is also fastened to the bearing frame 52, so that the forces and torques exerted thereon are directly introduced into the bearing frame 52 and from there can be introduced via the lashing means 54 onto the vessel and/or the platform.

By means of the container according to the invention, therefore, complex and expensive systems can be movably mounted and accommodated and operated directly from the container. This applies, in particular, to sonar systems but also to mine sweeping and/or mine clearance systems and other underwater moving bodies.

All features cited in the above description of the figures, in the claims and in the introduction to the description are able to be used individually and in any combination. The disclosure of the invention is therefore not limited to the described and/or claimed combinations of features. On the contrary, all combinations of features should be considered as being disclosed.

What is claimed is:

1. A sea container that can be closed on all sides, said container comprising:

a basic frame having four corner posts;

a top-side frame; and a bottom-side frame structure, the corner posts being fixedly connected to the top-side frame and the bottom-side frame structure, the bottom-side frame structure comprises:

a bearing frame structured and operable to have installations in the sea container fastened thereto, the bearing frame comprising:

lashing means for lashing down the sea container onto one of a vessel, a different offshore platform and a land-based platform, and for absorbing horizontally-acting forces, and for introducing at least one of forces and torques introduced into the bearing frame directly into the at least one of a vessel, a different offshore platform and a land-based platform on which the container is located.

2. The sea container according to claim 1, wherein the bottom-side frame structure above the bearing frame comprises:

an upper bottom-side frame welded to the bearing frame;

four corner fittings, two longitudinal members; and two transverse members, the corner fittings in being connected fixedly to one end of one of the corner posts.

3. The sea container according to claim 1, wherein the bearing frame comprises:

four corner fittings at its corners and two longitudinal bearing frame members fixedly connected to the said corner fittings; and two transverse bearing frame members fixedly connected to the corner fittings, the lashing means being provided between one or more pairs of adjacent corners of the bearing frame at least one of:

at least one of the longitudinal bearing frame members; and at least one of the transverse bearing frame members.

4. The sea container according to claim 3, wherein the bearing frame comprises transverse members that are arranged between the longitudinal bearing frame members and are fixedly connected thereto and to which at least one of the installations are fastened.

5. The sea container according to claim 3, wherein the installations comprise a winch for a trailing antenna of a sonar system, the winch being fastened to the bearing frame.

6. The sea container according to claim 5, wherein the winch is fastened at least one of the transverse members.

7. The sea container according to claim 3, wherein the installations comprise a deploying device for at least one of:

an unmanned underwater vessel;

a manned underwater vessel;

a surface water vessel; and an underwater moving body, the deploying device for deploying the at least one of the unmanned underwater vessel, the manned underwater vessel, the surface water vessel and the underwater moving body in sea water, the deploying device being fastened to the bearing frame.

8. The sea container according to claim 7, wherein the deploying device is fastened to at least one of the transverse members.

9. The sea container according to claim 1, wherein the bearing frame comprises at least one floor panel for shielding the container interior from the surroundings on the bottom-side, each floor panel comprising at least one draining means.

10. The sea container according to claim 9, wherein the draining means comprises at least one of bilge plugs, bilge flaps and bilge pumps.

11. The sea container according to claim 1, wherein the container interior is divided by a partition into a control room and a working space, the control room at least one of:

being hermetically sealed; and being able to be hermetically sealed from the surroundings.

12. The sea container according to claim 11, wherein the control room comprises at least one of an access door, an emergency exit, a window to the working space, an air conditioning system, heat insulation for insulating the control room relative to the surroundings, a heating system, fire extinguishing means, first-aid means, a satellite telephone system, communication devices for communication, including data communication, with the communication devices at least on of on-board the vessel accommodating the container and outside the vessel, data processing devices, an emergency power supply, a satellite navigation system, and an automatic identification system.

13. The sea container according to claim 12, wherein the data processing device is a signal processing devices of a sonar system.

14. The sea container according to claim 1, wherein the installations comprise a voltage transformer for providing at least one of a predetermined and a predeterminable initial voltage at variable input voltage.

15. The sea container according to claim 1, wherein the bottom-side frame structure comprises external earthing points for the electrical earthing of the sea container.

16. The sea container according to claim 15, wherein the bottom-side the bearing frame comprises the external earthing points for the electrical earthing of the sea container.

17. The sea container according to claim 3, wherein at least one of the longitudinal members and the transverse members of the basic frame are provided as cable ducts.

18. The sea container according to claim 17, wherein at least one of the upper bottom-side frame and the bearing frame are provided as cable ducts.

19. The sea contain according to claim 18, wherein at least one of the upper bottom-side frame and the bearing frame are provided with recesses and sealing elements which seal the recesses externally so that a region between the at least one of the upper bottom-side frame and the bearing frame and the sealing element forms a cable guide.

20. The sea container according claim 11, wherein the working space comprises an access door arranged on a side wall of the sea container, the sea container comprising a safety circuit which, when the access door is open, interrupts the electrical supply of an electrical drive in the working space, and when the access door is closed, connects the electrical supply.

21. The sea container according to claim 20, wherein the working space comprises an access door arranged on a side wall of the sea container, the sea container comprising a safety circuit which, when the access door is open, interrupts the electrical supply of at least one of the winch and the deploying system and, when the access door is closed, connects the electrical supply.

22. The sea container according to claim 5, wherein the winch comprises at least one of a mechanical locking brake and an impulse transmitter for determining the length of dispensed cable and trailing antenna and a winch control unit which is configured such that, during operation of the winch, a minimum number of windings of a tensioning cable remains on a winch drum.

23. The sea container according to claim 5, wherein the winch comprises a slip ring for transmitting at least one of electrical and optical signals.

* * * * *